US008852029B2

(12) United States Patent
Solheim et al.

(10) Patent No.: US 8,852,029 B2
(45) Date of Patent: Oct. 7, 2014

(54) GOLF HANDICAP SYSTEMS AND METHODS TO CALCULATE A GOLF HANDICAP

(75) Inventors: John A. Solheim, Phoenix, AZ (US); Michael R. Kuettner, Phoenix, AZ (US); John Bliss, Glendale, AZ (US); Dave Van Engelhoven, Paradise Valley, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 13/494,873

(22) Filed: Jun. 12, 2012

(65) Prior Publication Data

US 2012/0322582 A1 Dec. 20, 2012

Related U.S. Application Data

(60) Provisional application No. 61/496,963, filed on Jun. 14, 2011, provisional application No. 61/512,843, filed on Jul. 28, 2011.

(51) Int. Cl.

| | |
|---|---|
| ***A63B 69/36*** | (2006.01) |
| ***A63B 37/00*** | (2006.01) |
| ***A63B 57/00*** | (2006.01) |
| *A63B 47/00* | (2006.01) |

(52) U.S. Cl.

CPC ..... *A63B 37/0003* (2013.01); *A63B 2069/3602* (2013.01); *A63B 69/3688* (2013.01); *A63B 47/008* (2013.01); *A63B 57/00* (2013.01); *A63B 69/3655* (2013.01)

USPC ..... 473/409; 473/407

(58) Field of Classification Search

USPC ..... 473/131, 351, 373, 374, 378, 407, 409

See application file for complete search history.

(56) References Cited

U.S. PATENT DOCUMENTS

| | | | | |
|---|---|---|---|---|
| 5,398,418 | A * | 3/1995 | Jones | 33/1 SD |
| 6,074,312 | A * | 6/2000 | Lyon et al. | 473/409 |
| 6,658,371 | B2 * | 12/2003 | Boehm et al. | 702/182 |
| 6,742,385 | B2 * | 6/2004 | Katayama | 73/65.03 |
| 7,908,907 | B1 * | 3/2011 | Nelson et al. | 73/65.03 |
| 2002/0049508 | A1 * | 4/2002 | Williams | 700/92 |
| 2002/0152796 | A1 * | 10/2002 | Katayama | 73/11.01 |
| 2004/0204782 | A1 | 10/2004 | Kim | |
| 2008/0015054 | A1 * | 1/2008 | Kennedy et al. | 473/376 |
| 2011/0009215 | A1 * | 1/2011 | Ichikawa et al. | 473/409 |
| 2011/0021293 | A1 * | 1/2011 | York et al. | 473/407 |

FOREIGN PATENT DOCUMENTS

| | | |
|---|---|---|
| KR | 10-0466368 | 5/2005 |

OTHER PUBLICATIONS

International Search Report from corresponding PCT Application No. PCT/US2012/042512, dated Feb. 26, 2013.

Written Opinion from corresponding PCT Application No. PCT/US2012/042512, dated Feb. 26, 2013.

* cited by examiner

*Primary Examiner* — Nini Legesse

(57) ABSTRACT

Embodiments of golf handicap systems and methods to calculate a golf handicap are generally described herein. Other embodiments may be described and claimed.

6 Claims, 5 Drawing Sheets

| Ball Rating (Avg. 113) \ SLOPE RATING® (Avg. 113) | 63.0 | 73.0 | 83.0 | 93.0 | 103.0 | 113.0 | 123.0 | 133.0 | 143.0 | 153.0 |
|---|---|---|---|---|---|---|---|---|---|---|
| 63.0 | 3.1 | 3.6 | 4.1 | 4.6 | 5.1 | 5.6 | 6.1 | 6.6 | 7.1 | 7.6 |
| 73.0 | 3.6 | 4.2 | 4.7 | 5.3 | 5.9 | 6.5 | 7.0 | 7.6 | 8.2 | 8.7 |
| 83.0 | 4.1 | 4.7 | 5.4 | 6.0 | 6.7 | 7.3 | 8.0 | 8.6 | 9.3 | 9.9 |
| 93.0 | 4.6 | 5.3 | 6.0 | 6.8 | 7.5 | 8.2 | 9.0 | 9.7 | 10.5 | 11.2 |
| 103.0 | 5.1 | 5.9 | 6.7 | 7.5 | 8.3 | 9.1 | 9.9 | 10.7 | 11.5 | 12.3 |
| 113.0 | 5.6 | 6.5 | 7.3 | 8.2 | 9.1 | 10.0 | 10.9 | 11.8 | 12.7 | 13.5 |
| 123.0 | 6.1 | 7.0 | 8.0 | 9.0 | 9.9 | 10.9 | 11.8 | 12.8 | 13.8 | 14.7 |
| 133.0 | 6.6 | 7.6 | 8.6 | 9.7 | 10.7 | 11.8 | 12.8 | 13.9 | 14.9 | 15.9 |
| 143.0 | 7.1 | 8.2 | 9.3 | 10.4 | 11.5 | 12.7 | 13.8 | 14.9 | 16.0 | 17.1 |
| 153.0 | 7.6 | 8.7 | 9.9 | 11.1 | 12.3 | 13.5 | 14.7 | 15.9 | 17.1 | 18.3 |

Ball Rating (Average Ball Rating = 113)

| Handicap Index® | 63.0 | 73.0 | 83.0 | 93.0 | 103.0 | 113.0 | 123.0 | 133.0 | 143.0 | 153.0 |
|---|---|---|---|---|---|---|---|---|---|---|
| 0 | 0.0 | 0.0 | 0.0 | 0.0 | 0.0 | 0.0 | 0.0 | 0.0 | 0.0 | 0.0 |
| 1 | 0.6 | 0.6 | 0.7 | 0.8 | 0.9 | 1.0 | 1.1 | 1.3 | 1.5 | 1.4 |
| 2 | 1.1 | 1.3 | 1.5 | 1.6 | 1.8 | 2.0 | 2.2 | 2.4 | 2.5 | 2.7 |
| 3 | 1.7 | 1.9 | 2.2 | 2.5 | 2.7 | 3.0 | 3.3 | 3.5 | 3.8 | 4.1 |
| 4 | 2.2 | 2.6 | 2.9 | 3.3 | 3.6 | 4.0 | 4.4 | 4.7 | 5.1 | 5.4 |
| 5 | 2.8 | 3.2 | 3.7 | 4.1 | 4.6 | 5.0 | 5.4 | 5.9 | 6.3 | 6.8 |
| 6 | 3.3 | 3.9 | 4.4 | 4.9 | 5.5 | 6.0 | 6.5 | 7.1 | 7.6 | 8.1 |
| 7 | 3.9 | 4.5 | 5.1 | 5.8 | 6.4 | 7.0 | 7.6 | 8.2 | 8.9 | 9.5 |
| 8 | 4.5 | 5.2 | 5.9 | 6.6 | 7.3 | 8.0 | 8.7 | 9.4 | 10.1 | 10.8 |
| 9 | 5.0 | 5.8 | 6.6 | 7.4 | 8.2 | 9.0 | 9.8 | 10.6 | 11.4 | 12.2 |
| 10 | 5.6 | 6.5 | 7.3 | 8.3 | 9.1 | 10.0 | 10.9 | 11.8 | 12.7 | 13.5 |
| 11 | 6.1 | 7.1 | 8.1 | 9.1 | 10.0 | 11.0 | 12.0 | 12.9 | 13.9 | 14.8 |
| 12 | 6.7 | 7.8 | 8.8 | 9.9 | 10.9 | 12.0 | 13.1 | 14.1 | 15.2 | 16.2 |
| 13 | 7.2 | 8.4 | 9.5 | 10.7 | 11.8 | 13.0 | 14.2 | 15.3 | 16.5 | 17.6 |
| 14 | 7.8 | 9.0 | 10.3 | 11.5 | 12.8 | 14.0 | 15.2 | 16.5 | 17.7 | 19.0 |
| 15 | 8.4 | 9.7 | 11.0 | 12.3 | 13.7 | 15.0 | 16.3 | 17.7 | 19.0 | 20.3 |
| 16 | 8.9 | 10.3 | 11.8 | 13.2 | 14.6 | 16.0 | 17.4 | 18.8 | 20.2 | 21.7 |
| 17 | 9.5 | 11.0 | 12.5 | 14.0 | 15.5 | 17.0 | 18.5 | 20.0 | 21.5 | 23.0 |
| 18 | 10.0 | 11.6 | 13.2 | 14.8 | 16.4 | 18.0 | 19.6 | 21.2 | 22.8 | 24.4 |
| 19 | 10.6 | 12.3 | 14.0 | 15.6 | 17.3 | 19.0 | 20.7 | 22.4 | 24.0 | 25.7 |
| 20 | 11.2 | 12.9 | 14.7 | 16.5 | 18.2 | 20.0 | 21.8 | 23.5 | 25.3 | 27.1 |
| 21 | 11.7 | 13.6 | 15.4 | 17.3 | 19.1 | 21.0 | 22.9 | 24.7 | 26.6 | 28.4 |
| 22 | 12.3 | 14.2 | 16.2 | 18.1 | 20.1 | 22.0 | 23.9 | 25.9 | 27.8 | 29.8 |
| 23 | 12.8 | 14.9 | 16.9 | 18.9 | 21.0 | 23.0 | 25.0 | 27.1 | 29.1 | 31.1 |
| 24 | 13.4 | 15.5 | 17.6 | 19.8 | 21.9 | 24.0 | 26.1 | 28.2 | 30.4 | 32.5 |
| 25 | 13.9 | 16.2 | 18.4 | 20.6 | 22.8 | 25.0 | 27.2 | 29.4 | 31.6 | 33.8 |
| 26 | 14.5 | 16.8 | 19.1 | 21.4 | 23.7 | 26.0 | 28.3 | 30.6 | 32.9 | 35.2 |
| 27 | 15.1 | 17.4 | 19.8 | 22.2 | 24.6 | 27.0 | 29.4 | 31.8 | 34.2 | 36.6 |
| 28 | 15.6 | 18.1 | 20.6 | 23.0 | 25.5 | 28.0 | 30.5 | 33.0 | 35.4 | 37.9 |
| 29 | 16.2 | 18.7 | 21.3 | 23.9 | 26.4 | 29.0 | 31.6 | 34.1 | 36.7 | 39.3 |
| 30 | 16.7 | 19.4 | 22.0 | 24.7 | 27.3 | 30.0 | 32.7 | 35.3 | 38.0 | 40.6 |

FIG. 3

| Slope Rating® | Ball Rating | Golf Handicap |
|---|---|---|
| 96 | 133 | 10.0 |
| 104 | 123 | 10.0 |
| 113 | 113 | 10.0 |
| 124 | 103 | 10.0 |
| 137 | 93 | 10.0 |

FIG. 4

GOLF HANDICAP SYSTEMS AND METHODS TO CALCULATE A GOLF HANDICAP

CROSS-REFERENCE TO RELATED APPLICATIONS

This application claims the benefit of U.S. Provisional Application 61/496,963, filed Jun. 14, 2011, and U.S. Provisional Application 61/512,843, filed Jul. 28, 2011. The disclosures of the referenced applications are incorporated herein by reference.

TECHNICAL FIELD

The present disclosure relates generally to golf, and more particularly, to golf handicap systems and methods to calculate a golf handicap.

BACKGROUND

For years, a golf handicap (i.e., a numerical value) has been used to indicate an individual's ability to play golf based on tee box location of a particular golf course. For example, the United States Golf Association (USGA) developed a handicap system (i.e., the USGA Handicap System™) that allows individuals to compete with each other on any golf course, regardless of their skill level, by providing a type of normalized golf score. In particular, the USGA's handicap formula is made up of a series of calculations, which take into account an individual's handicap based on multiple factors such as an Equitable Stroke Control™ Score (or the adjusted gross score), a Course Rating™, a Slope Rating®, and the average value of all Slope Ratings® (e.g., 113). While other golf standard organizations, governing bodies, and/or rule establishing entities such as the Royal and Ancient Golf Club of St. Andrews (R&A) and the Royal Canadian Golf Association use different handicap systems for playing golf outside of the United States and Mexico, none of the handicap systems mentioned above incorporates a rating associated with golf equipment used by an individual to play golf into the calculation of a golf handicap.

BRIEF DESCRIPTION OF THE DRAWINGS

FIG. 3 depicts a visual diagram representation of the example golf handicap system.

FIG. 4 depicts a visual diagram representation of the example golf handicap system.

DESCRIPTION

Figures 1, 2:
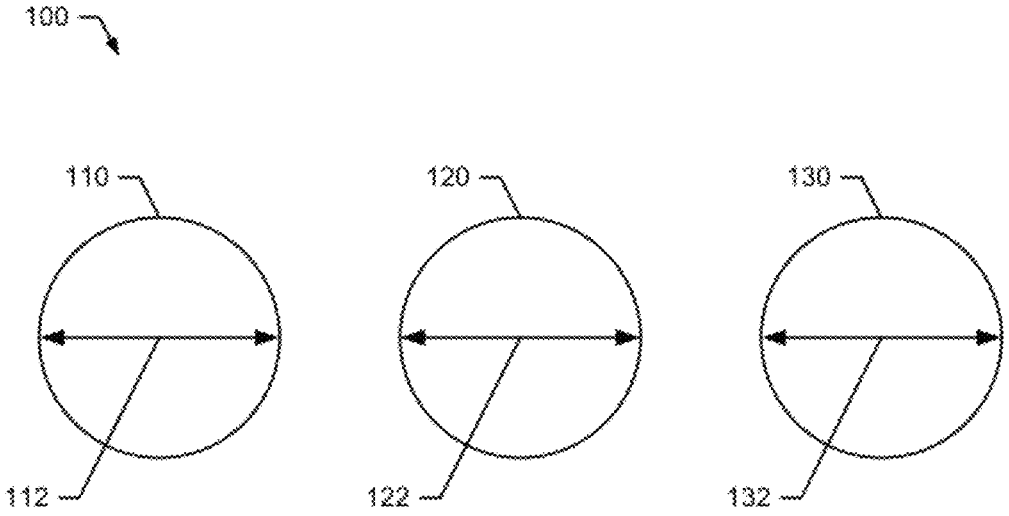
FIG. 1 depicts a visual diagram representation of an example plurality of golf balls.
FIG. 2 depicts a visual diagram representation of an example golf handicap system.

In general, golf handicap systems and methods to calculate a golf handicap are described herein. The systems, methods, and articles of manufacture described herein may provide a golf handicap based on not only a rating associated with a golf course played by an individual but also a rating associated with equipment used by the individual to play that particular golf course. In one example, the golf handicap may be based on a ball rating associated with the golf ball used by the individual to play golf on a particular golf course. By including a ball rating into the calculation of a golf handicap, certain golf courses may become easier or more challenging, individuals with different golf skills may have more competitive rounds of golf while playing against each other, etc. The systems, methods, apparatus, and articles of manufacture described herein are not limited in this regard.

In general, golf standard organizations, governing bodies, and/or rule establishing entities such as the United States Golf Association (USGA), the Royal and Ancient Golf Club of St. Andrews (R&A), and the Royal Canadian Golf Association may use different golf handicap systems to calculate a golf handicap. In one example, the USGA Handicap System™ provides a course handicap based on Handicap Differential™ and Handicap Index®. As shown in Equation #1 below, the Handicap Differential™ is calculated based on an Equitable Stroke Control™ Score (ESC™ Score), a Course Rating™, a Slope Rating®, and an average value of all Slope Ratings® (e.g., 113):

$$\text{Handicap Differential}^{\text{™}} = \frac{(ESC\,\text{™ Score} - \text{Course Rating™}) \times 113}{\text{Slope Rating®}}.$$

The ESC™ Score defines a limit to the number of strokes that an individual may post on a hole based on the Course Handicap™. The Course Rating™ is a numerical value associated with each tee box position (e.g., front tees, middle tees, back tees, etc.) of a particular golf course that approximates the number of strokes for a scratch golfer (e.g., an individual who shoots par or better) to complete the golf course (e.g., between 67 and 77). In one example, the front tees of a golf course may be 68.0, the middle tees may be 70.5, and back tees may be 73.6. The Course Rating™ is subtracted from the ESC™ Score to provide the number of strokes that the individual deviated from the expected score on a particular golf course. The difference between the ESC™ Score and the Course Rating™ is multiplied by 113. This value is then divided by a Slope Rating® to calculate the Handicap Differential™. The Slope Rating® is a numerical value associated with the difficulty of a particular golf course for a bogey golfer (e.g., an individual who shoots an average of about 90, or a bogey per hole) relative to the Course Rating™. The Course Rating™ may indicate the difficulty of a golf course to a scratch golfer whereas the Slope Rating® may indicate the difficulty of the golf course to a bogey golfer. In contrast to the Course Rating™, the Slope Rating® does not specifically relate to the number of strokes. For example, the minimum slope rating value is 55 and the maximum slope rating value is 155 with a golf course of average difficulty having a slope rating value of 113.

As shown in Equation #2 below, the Handicap Index® may be calculated based on the Handicap Differential™ (i.e., Equation #1):

$$\text{Handicap Index ®} = \frac{\sum_{n=1}^{X} \text{Handicap Differential®}}{X} \times 0.96.$$

After calculating a number of Handicap Differential™ values (i.e., "x" number of Handicap Differentials™), some of those Handicap Differential™ values may be summed and then divided by the number of Handicap Differential™ values summed (i.e., divided by 'x'). In one example, the lowest ten Handicap Differential™ values from the last twenty values (i.e., last twenty rounds of golf) may be summed and then averaged (e.g., divided by ten). This averaged Handicap Differential™ value may be multiplied by 0.96 to calculate the Handicap Index®.

As shown in Equation #3 below, the course handicap of an individual may be calculated based on the Handicap Index® (i.e., Equation #2) and the Slope Rating® of the golf course being played:

$$\text{Course Handicap}^{\text{TM}} = \frac{\text{Handicap Index ®} \times \text{Slope Rating ®}}{113}.$$

In particular, the Handicap Index® and the Slope Rating® may be multiplied together, which may be then divided by 113 (e.g., an average value of the Slope Rating®). While the above example may describe a particular method to calculate the course handicap, the systems, methods, and articles of manufacture described herein may use other methods to calculate the course handicap (e.g., without the Slope Rating®). Course Rating™, Equitable Stroke Control™, ESC™, Handicap Differential™, Handicap Index®, Handicap System™, Slope Rating®, and USGA Handicap System™ are trademarks of the USGA.

One reason behind golf handicap is to allow competitive rounds of golf between individuals with different skill levels. However, golf handicap has evolved into more than a tool for individuals to compete head to head. Instead, golf handicap has become a basis for tournament selections, a type of status symbol in golf, and a universally accepted method of designating an individual's golf skills. Golf handicap is a modern cornerstone to the historically rich game of golf. For these reasons, accuracy and precision in calculating golf handicap are needed. In the USGA Handicap System™, for example, the integration of Slope Rating® into Handicap Differential™ and Course Handicap™ as shown above is an example of a governing body improving the calculation of a golf handicap. However, more may be done to further improve on the accuracy and precision in calculating golf handicap.

In contrast to existing handicap systems that use a rating associated with a golf course only (e.g., the USGA Handicap System™ as described above), the systems, methods, and articles of manufacture described herein may incorporate a rating associated with equipment used by an individual to play golf (e.g., a golf ball rating and/or a golf club rating) into the calculation of a golf handicap. In general, the systems, methods, and articles of manufacture described herein may calculate a golf handicap based on the course handicap (e.g., the course handicap mentioned above) and an equipment rating associated with at least one piece of equipment used by an individual to play golf (e.g., a ball rating and/or a club rating). By including a ball rating, for example, into the calculation of a golf handicap, certain golf courses may become easier or more challenging to an individual. Ball rating may also allow individuals with different skill levels to have more competitive rounds of golf while playing against each other.

Many different factors may affect an individual's golf game such as weather, golf course conditions, equipment such as golf balls and golf clubs, etc. Existing golf handicap systems do not account for most, if not all, of these factors. As described in detail below, a golf handicap system incorporating an equipment rating (e.g., ball rating and/or club rating) may help individuals to maintain a relatively more consistent golf handicap despite uncontrollable changes (e.g., weather) or conversely controllable changes (e.g., golf course conditions) in some of the factors mentioned above.

With a golf handicap system incorporating ball rating as described herein, for example, an individual may select a golf ball based on playing weather conditions, course conditions, skill level, etc. for a round of golf. In one example, if an individual is playing a round of golf on a windy day, he or she may choose to play with a golf ball designed to travel a relatively shorter distance to help mitigate or avoid catastrophic mishits. The golf ball may be associated with a relatively higher ball rating, which mitigates the detrimental effects of a "bad-weather" golf day by raising the individual's golf handicap for that round of golf. As a result, an individual's adjusted handicap index as described below may compensate for the less-than-ideal playing conditions.

A golf handicap system incorporating ball rating may also allow an individual to experiment with new courses and/or new equipment while limiting the learning curve. For example, an individual may select a more or less favorable golf ball based on the landscape of an unfamiliar golf course. If the golf course is relatively longer in yardage (e.g., more than 7,300 yards), then the individual may select a relatively lower-rated golf ball (i.e., a golf ball that travels relatively farther distance) to help alleviate the learning curve of an unfamiliar and relatively longer course without adversely affecting the individual's golf score (i.e., net score, which is the gross score minus the golf handicap).

Conversely, if the golf course is relatively shorter in yardage (e.g., less than 6,900 yards), includes numerous dogleg golf holes, and/or includes relatively narrow fairways, the individual may choose a relatively higher-rated golf ball. The relatively higher-rated golf ball (i.e., a golf ball that travels relatively shorter distance) may allow the individual to keep his or her swing and accuracy while catering to the landscape of the course, without adversely affecting the individual's golf score (i.e., net score).

In another example, when individuals purchase and/or test new equipment, a relatively lower-rated (or relatively higher-rated) golf ball may help to alleviate the learning curve. The individual may use new equipment in actual playing conditions and under a competitive environment without fear of a significant impact to his or her golf score.

Further, golf courses may find use in, and benefit from, a golf handicap system incorporating ball rating or other equipment rating (e.g., club rating). In particular, a golf course may adopt a "recommended ball" for pin placement, tee box placement, grass conditions, and/or weather conditions on any particular day. As a result, some golf courses may no longer be overlooked as golf tournament sites for being too easy or too short in yardage. That is, a golf course may adopt a relatively higher-rated golf ball, which makes the golf course play longer and/or be more challenging to accommodate for individuals with relatively better playing abilities and greater skill levels (e.g., professional golfers).

In another example, a golf course may select a relatively lower ball rating for use in an amateur tournament whereas the golf course may select a relatively higher rating for golf balls used in a professional tournament to compensate for the Slope Rating® of the golf course. The Slope Rating® of a golf course, which is assigned by the USGA, may not be readily changed. In contrast with a ball rating system as described herein, the golf course may have greater control over the perceived level of difficulty by adopting or designating a ball rating based on playing conditions. A ball rating system may provide golf courses the opportunity to market to individuals of all skill levels and operate as a relatively more dynamic course (e.g., a long or short course, a difficult or easy course, etc. based on the individuals playing at that course). For country clubs and other private courses with high numbers of returning patrons, a change in recommended ball may keep those courses playing like new courses. For example, an individual who plays a particular golf course repeatedly may be able to return and play the same exact course but have different playing experiences by using different rated golf balls. As described in detail below, the systems, methods, and articles of manufacture described herein take ball rating into account for calculating an adjusted handicap differential and an adjusted handicap index so that an individual's golf score may be more accurate and precise.

Existing golf handicap systems allow golf to be competitive between individuals with different skill levels. The addition of ball rating (and/or club rating) may further improve the competitive nature of golf. As mentioned above, for example, a golf course may be able to offer different skill-level tournaments, create better playing conditions on a bad weather day, compliment or compensate for course conditions (e.g., soft bunkers, narrow fairways, thick roughs, firm putting greens, etc.), keep patrons coming back, circumvent some of other peripheral factors of golf, and/or create an overall improvement in the accuracy, precision, and enjoyment of the golf experience by designating a ball rating (and/or club rating).

In the example of FIG. 1, each of the golf balls 100, generally shown as 110, 120, and 130, may be associated with a golf ball rating. In one example, the first golf ball 110 may be associated with a first golf ball rating, the second golf ball 120 may be associated with a second golf ball rating, and the third golf ball 130 may be associated with a third golf ball rating. The ball rating may correspond to an overall distance traveled by the golf ball (e.g., carry distance plus roll distance). For example, the overall distance may be include the distance that a golf ball carries in the air (i.e., carry distance) and the distance that the golf ball rolls on the ground after landing (i.e., roll distance). The overall distance may be defined by Overall Distance Standard of the USGA, which details launch conditions and other testing parameters. Based on the Overall Distance Standard, for example, the highest ball rating may correspond to a golf ball with an overall distance of 320 yards (i.e., overall distance of 317 yards with a maximum tolerance of three yards). The systems, methods, apparatus, and articles of manufacture described herein are not limited in this regard.

For example, the first golf ball 110 may not travel as far as the second and third golf balls 120 and 130, respectively. In contrast, the third golf ball 130 may travel farther than the first and second golf balls 110 and 120, respectively. Accordingly, the second golf ball 120 may travel farther than the first golf ball 110 but may not travel as far as the third golf ball 130. The ball rating may be based on one or more ball characteristics that affect the overall distance traveled by a golf ball such as diameter, weight, ball compression, cover material, cover hardness, cover thickness, dimple pattern, dimple count, spin rate, coefficient of lift, or coefficient of drag. Other specifications of the first, second, and third golf balls 110, 120, and 130, respectively, (weight, initial velocity, etc.) may conform to the rules as defined by golf standard organizations and/or governing bodies such as the USGA and the R&A. For example, the golf balls 100 may be less than or equal to 1.620 ounces (45.93 grams) as specified by the USGA. In another example, the first golf ball 110 may be associated with a first diameter 112, the second golf ball 120 may be associated with a second diameter 122, and the third golf ball 130 may be associated with a third diameter 132. While the first, second, and third diameters 112, 122, and 132, respectively, may be different from each other, the diameter of each of the golf balls 100 may be greater than or equal to 1.68 inches (42.67 millimeters) as specified by the USGA. The systems, methods, apparatus, and articles of manufacture described herein are not limited in this regard.

The systems, methods, and articles of manufacture described herein may generate an adjusted handicap differential (AHD) based on the ball rating. As shown in Equation #4 below, the adjusted handicap differential (AHD) is the product of the Handicap Differential™ (i.e., derived from Equation #1 mentioned above) and the average golf ball rating divided by the golf ball rating:

$$AHD = \frac{(ESC\ \text{Score} - \text{Course Rating}\ ™) \times 113}{\text{Slope Rating}\ ®} \times \frac{\text{Average Ball Rating}}{\text{Ball Rating}}$$

or $$AHD = \frac{\text{Handicap Differential}™ \times \text{Average Ball Rating}}{\text{Ball Rating}}.$$

To avoid overcompensation, the ball rating may be based on the Slope Rating® of the USGA Handicap System™. For example, an average ball rating may have a value of 113 with the ball rating ranging from a minimum value of 55 to a maximum value of 155. Analogous to the Slope Rating®, relatively easier golf balls (e.g., golf balls travel farther distance) may have lower ball rating whereas relatively more difficult golf balls (e.g., travel shorter distance) may have higher ball rating. That is, a golf ball with a ball rating of 83 may travel farther distance than a golf ball with a ball rating of 143. Based on the Overall Distance Standard of the USGA, for example, a golf ball associated with an overall distance of 320 yards may have a ball rating of 55. As a result, the ball rating and the Slope Rating® may be weighted equally to calculate the adjusted handicap differential (Equation #4).

As shown in Equation #5 below, the adjusted handicap index (AHI) may be calculated based on the adjusted handicap differential (AHD) (i.e., Equation #4):

$$AHI = \frac{\sum_{n=1}^{X} AHD}{X} \times 0.96.$$

After calculating a number of AHD values, some of those AHD values may be summed (i.e., "x" number of AHD values summed) and then divided by the number of values summed (i.e., then divided by "x"). In one example, the lowest ten AHD values from the last twenty AHD values (i.e., last twenty rounds of golf) may be summed and then averaged. This averaged AHD value may be multiplied by a factor of 0.96 to calculate the adjusted handicap index. The factor of 0.96 may be a small percentage below perfect equity defined by the USGA (i.e., an incentive for an individual to improve his or her golf game). The systems, methods, apparatus, and articles of manufacture described herein are not limited in this regard.

By using a similar scale as the Slope Rating® with a minimum value of 55, a maximum value of 155, and an average value of 113, the ball rating may affect the Handicap Index® in an appropriate manner (i.e., without overcompensation). Referring to FIG. 2, for example, a golf ball with an average rating of 113 does not change the Handicap Index® (i.e., the Handicap Index® and the adjusted handicap index are equal to each other). Further, the ball rating may affect a relatively lower Handicap Index® less than a relatively higher Handicap Index®. By using a relatively easier golf ball such as a golf ball with a ball rating of 83 (i.e., a golf ball that travels farther distance than a golf ball with the average ball rating of 113), for example, an individual with a relatively low Handicap Index® such as 10 may change to an adjusted handicap index of 7.3 (i.e., a decrease of 2.7). On the other hand, that same individual may change from a Handicap Index® of 10 to an adjusted handicap index of 12.7 (i.e., an increase of 2.7) by using a relatively harder golf ball such as a golf ball with a ball rating of 143. As a result, the individual may be awarded for using a golf ball with a relatively higher ball rating (e.g., 143) than for using a golf ball with a relatively lower ball rating (e.g., 83).

In another example, an individual with a relatively high Handicap Index® such as 20 may change to an adjusted handicap index of 14.7 (i.e., a decrease of 5.3) by using a relatively easier golf ball such as a golf ball with a ball rating of 83 (i.e., a golf ball that travels farther distance than a golf ball with the average ball rating of 113), On the other hand, that same individual may change from a Handicap Index® of 20 to an adjusted handicap index of 25.3 (i.e., an increase of 5.3) by using a relatively harder golf ball such as a golf ball with a ball rating of 143. If both individuals used a golf ball with a ball rating of 83, the individual with a Handicap Index® such as 10 may experience a change of 2.7 (i.e., an adjusted handicap index (AHI) of 7.3) whereas the individual with a Handicap Index® such as 20 may experience a change of 5.3 (i.e., an adjusted handicap index (AHI) of 14.7). As a result, the adjusted handicap index (AHI) may change from the Handicap Index® more significantly as the Handicap Index® value increases (i.e., the AHI is a function of the individual's Handicap Index®).

As shown in Equation #6 below, the golf handicap of an individual may be calculated based on the adjusted handicap index (AHI) (i.e., Equation #5) and the ball rating of the golf ball used by the individual to play a round of golf:

$$\text{Golf Handicap} = \frac{AHI \times \text{Ball Rating}}{\text{Average Ball Rating}}.$$

In particular, the adjusted handicap index (AHI) and the ball rating may be multiplied together. To calculate the golf handicap (i.e., Equation #6), the product of the adjusted handicap index (AHI) and the ball rating may be divided by the average ball rating. As mentioned in the above example, the ball rating and the average ball rating may be based on the Slope Rating® of the USGA Handicap System™ so that the ball rating and the Slope Rating® may be weighted similarly to avoid overcompensation by the ball rating as illustrated in FIG. 4. The Slope Rating® and the ball rating may have an inversely proportional relationship to keep the golf handicap constant as the Slope Rating® varies with different golf courses. That is, if the Slope Rating® and the ball rating are offsetting each other, the golf handicap does not change the course handicap (i.e., handicap without the ball rating). As the Slope Rating® increases, however, the ball rating may need to be decreased to keep the golf handicap constant and vice versa. For example, an individual may play a golf course with a Slope Rating® of 96. To maintain the same golf handicap, the individual may use a golf ball having a ball rating of 133 to compensate for a golf course that is relatively easier than an average-rated golf course (i.e., 113).

Figure 5:
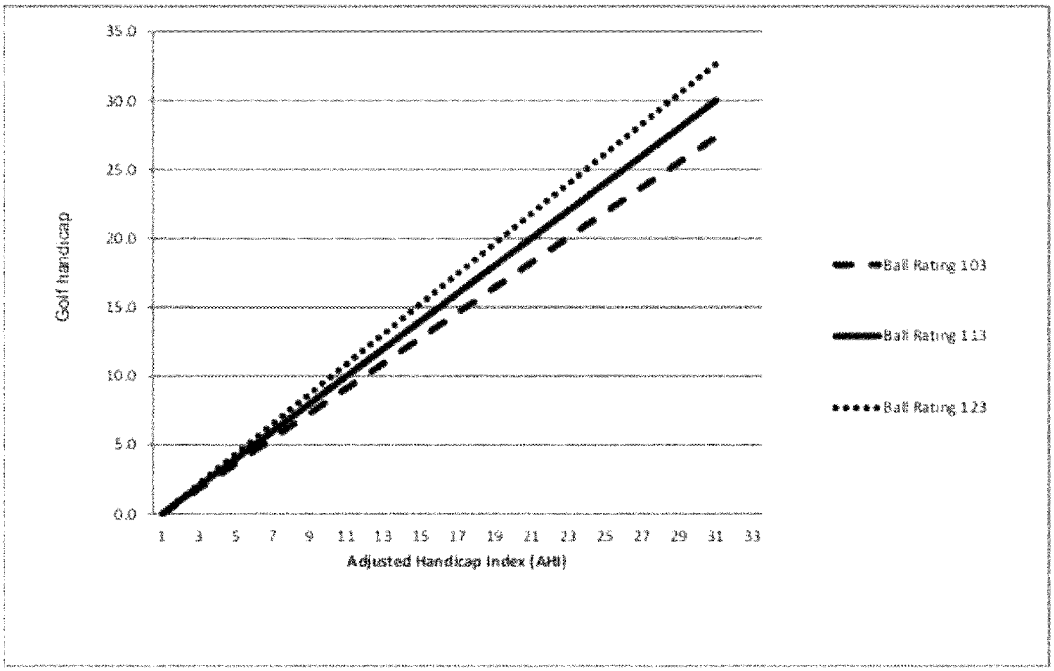
FIG. 5 depicts a visual diagram representation of the example golf handicap system.

Referring to FIG. 5, for example, a golf handicap of an individual may adjust based on the ball rating. In particular, a golf handicap of an individual who played with a golf ball having an average ball rating of 113 is shown as a solid line. If the individual uses a golf ball with a ball rating of 123 (e.g., a golf ball that travels shorter than a golf ball having an average ball rating of 113), the golf handicap increases to compensate for the individual using a golf ball that may not travel as far as an average-rated golf ball. By increasing the golf handicap, the individual may have a better net score. In contrast, if the individual uses a golf ball with a ball rating of 103 (e.g., a golf ball that travels farther than a golf ball having an average ball rating of 113), the golf handicap decreases to compensate for the individual using a golf ball that may travel farther than an average-rated golf ball.

Accordingly, the golf handicap of an individual incorporates not only a rating associated with the particular golf course played by the individual (e.g., the Slope Rating®) but also a rating associated with the golf ball used by the individual to play that golf course. By incorporating an equipment rating such as a ball rating, the golf handicap may be more precise and accurate with another factor in addition to a rating associated with the golf course played by an individual. The systems, methods, apparatus, and articles of manufacture described herein are not limited in this regard.

Alternatively, the ball rating may be scaled in a different manner (e.g., the ball rating and the Slope Rating® may be scaled or weighted differently). In one example, the ball rating may be scaled differently with a minimum value of 6, an average value of 8, and a maximum value of 10. A golf ball associated with a ball rating of 8 may travel farther (e.g., 10 to 20 yards) than golf balls associated with either a ball rating of 6 or a ball rating of 7. However, a golf ball associated with a ball rating of 8 may not travel farther (e.g., 10 to 20 yards) than golf balls associated with either a ball rating of 9 or a ball rating of 10. Similar to the above example, the golf handicap may be more precise and accurate with another factor in addition to a rating associated with the golf course played by an individual. The systems, methods, apparatus, and articles of manufacture described herein are not limited in this regard.

Figure 6:
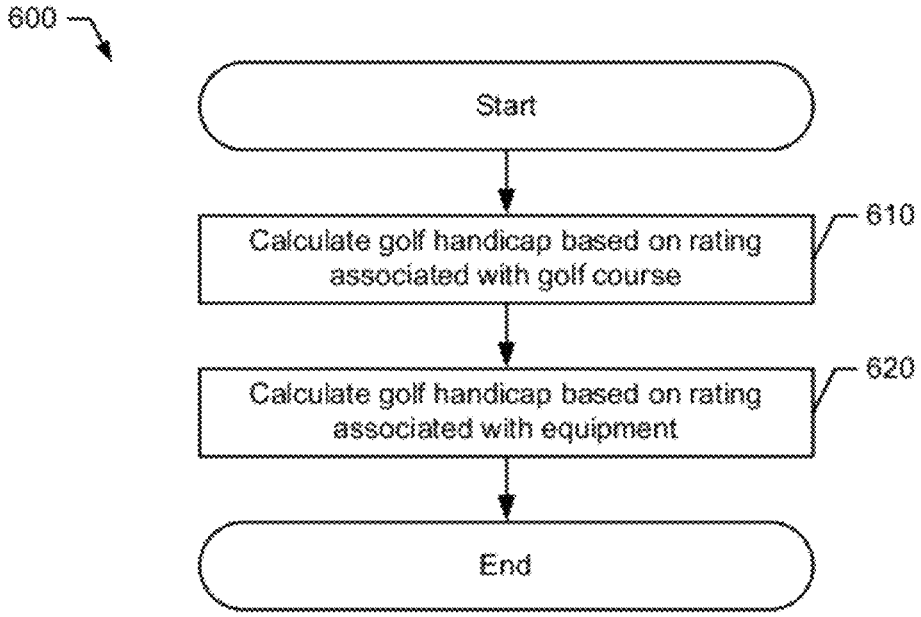
FIG. 6 depicts a flow diagram representation of one manner in which the example golf handicap system may operate.

In the example of FIG. 6, a process 600 may begin with calculating a course handicap based on at least one rating associated with a golf course played by an individual (block 610). In particular, the rating associated with the golf course may be a value indicating the difficulty of a golf course.

The process 600 may calculate a golf handicap based on the course handicap and at least one rating associated with golf equipment used by the individual to play the golf course (block 620). For example, the rating associated with golf equipment used by the individual may be a ball rating associated with a golf ball used by the individual to play golf at the golf course. In another example, the rating associated with golf equipment used by the individual may be a club rating associated with a driver-type golf club or a wedge-type golf club used by the individual to play golf at the golf course. Alternatively, the process 600 may calculate the golf handicap based on both a ball rating and a club rating as described in further detail below.

Figure 7:
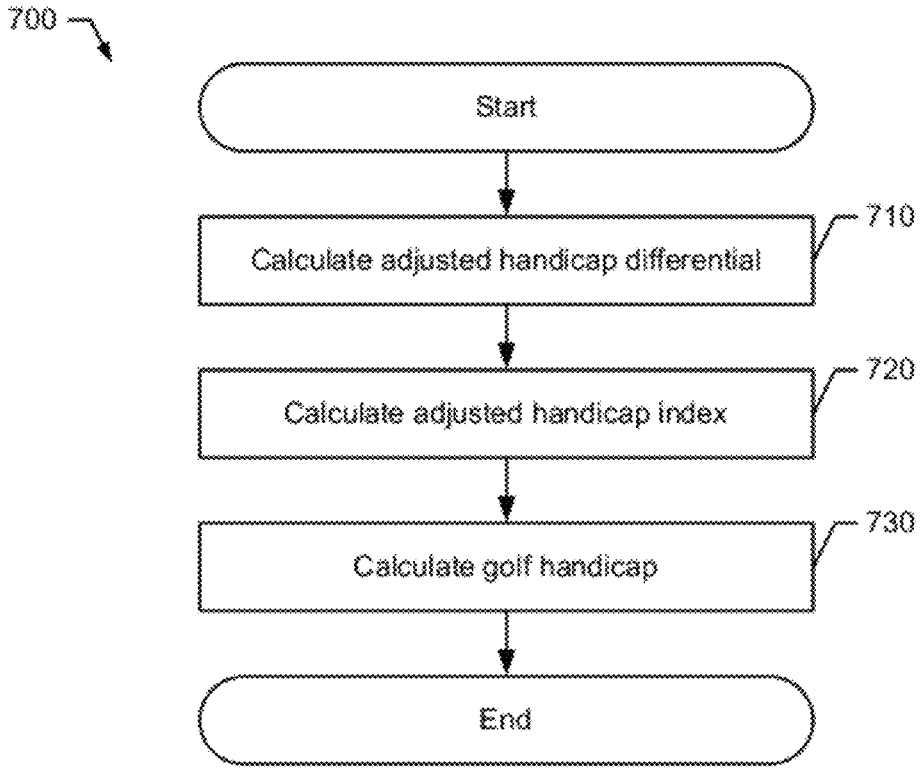
FIG. 7 depicts a flow diagram representation of another manner in which the example golf handicap system may operate.

As described in detail below, the ball rating may be incorporated into existing handicap system such as the USGA Handicap System™. Referring to FIG. 7, for example, the process 700 may begin with calculating an adjusted handicap index (block 710). In particular, the adjusted handicap differential (AHD) may be the product of the Handicap Differential™ of an individual and an average ball rating, which in turn is divided by the ball rating of the golf ball used by the individual. (e.g., Equation #4).

The process 700 may calculate an adjusted handicap index (AHI) based on the adjusted handicap differential (AHD) (block 720). As described above in connection with Equation

#5, the adjusted handicap index (AHI) may be based on a number of adjusted handicap differential (AHD) values. In particular, an average adjusted handicap differential (AHD) may be calculated from the sum of the lowest ten AHD values from the last twenty AHD values (i.e., last twenty rounds of golf). This average AHD may be multiplied by a percentage factor defined by the USGA to produce the adjusted handicap index (AHI).

The process 700 may calculate a golf handicap based on the adjusted handicap index (AHI) (block 730). As described above in connection with Equation #6, the golf handicap may be the product of the adjusted handicap index and a ball rating divided by an average ball rating. As mentioned above, the ball rating may be a numerical value associated with a golf ball used by the individual to play a round of golf.

Although the processes 600 and 700 may be depicted as separate processes in FIGS. 6 and 7, the processes 600 and 700 may be performed sequentially, concurrently, or simultaneously with other processes associated with the systems, methods, and articles of manufacture described herein. While a particular order of actions is illustrated in both FIGS. 6 and 7, these actions may be performed in other temporal sequences. For example, two or more actions depicted in FIG. 6 or FIG. 7 may be performed sequentially, concurrently, or simultaneously. Alternatively, two or more actions depicted may be performed in reversed order (e.g., the process 600 may perform block 620 before block 610). Further, one or more actions depicted in FIG. 6 or FIG. 7 may not be performed at all. The systems, methods, apparatus, and articles of manufacture described herein are not limited in this regard.

The example processes 600 and 700 of FIGS. 6 and 7, respectively, may be implemented as machine-accessible instructions utilizing any of many different programming codes stored on any combination of machine-accessible media such as a volatile or non-volatile memory or other mass storage device (e.g., a floppy disk, a CD, and a DVD). For example, the machine-accessible instructions may be embodied in a machine-accessible medium such as a programmable gate array, an application specific integrated circuit (ASIC), an erasable programmable read only memory (EPROM), a read only memory (ROM), a random access memory (RAM), a flash memory, a magnetic media, an optical media, and/or any other suitable type of medium. In addition or alternatively, the machine-accessible instructions may be embodied in an online application and/or a mobile application (e.g., an app) for various wired and/or wireless communication devices such as desktop computers, laptop computers, handheld computers, tablet computers, smartphones, etc. The systems, methods, apparatus, and articles of manufacture described herein are not limited in this regard.

While the above discloses example systems including, among other components, software or firmware executed on hardware, it should be noted that such systems are merely illustrative and should not be considered as limiting. In particular, it is contemplated that any or all of the disclosed hardware, software, and/or firmware components could be embodied exclusively in hardware, exclusively in software, exclusively in firmware or in some combination of hardware, software, and/or firmware.

Figure 8:
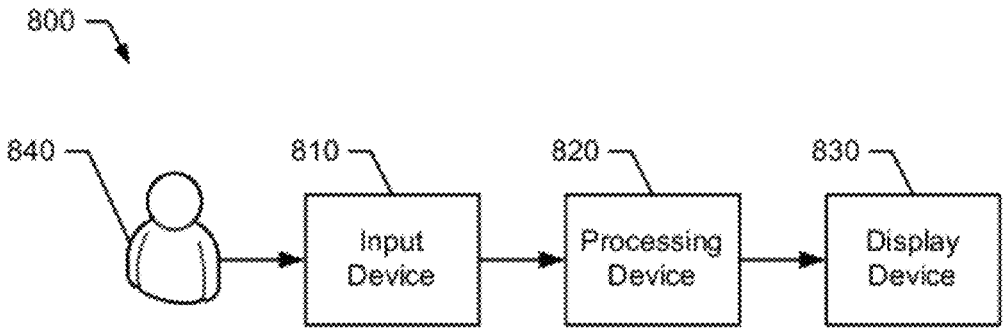
FIG. 8 depicts a block diagram representation of an example golf handicap system according to an embodiment of the methods, apparatus, systems, and articles of manufacture described herein.

Referring to FIG. 8, for example, a golf handicap system 800 may include an input device 810, a processing device 820, and a display device 830. The input device 810, the processing device 820, and the display device 830 may be coupled to each other via one or more wireless or wired connections. The input device 810 may permit an individual 840 to enter data and commands into the processing device 820. For example, the input device 810 may be implemented by a keyboard, a mouse, a touch-sensitive display, a track pad, a track ball, a voice recognition system, and/or other suitable human interface device (HID). For example, the individual 840 may input a ball rating via the input device 810. The processing device 820 may perform the processes 600 and/or 700 as described above to calculate a golf handicap. The display device 830 may generate the golf handicap. Although FIG. 8 may depict one or more components being separate blocks, two or more components of the golf handicap system 800 may be integrated into a single block.

While the above examples may be described in connection with a golf ball, the systems, methods, and articles of manufacture described herein may be applicable to other types of golf equipment such as golf clubs (e.g., driver-type golf clubs or wedge-type golf clubs). In particular, a golf club rating may be used to calculate the golf handicap. For example, the golf club rating may be based on dimension, volume, moment of inertia (MOI), spin propensity, spring effect and dynamic properties, grooves, etc.

While the above examples may be described in connection with an equipment rating of a single piece of golf equipment (e.g., a ball rating or a club rating), the systems, methods, and articles of manufacture described herein may be applicable to various combinations of golf equipment such as a club rating (e.g., driver-type golf clubs or wedge-type golf clubs) in addition to a ball rating. For example, the golf handicap may be based on an equipment rating associated with the golf ball and the golf clubs used by an individual to play golf (i.e., the equipment rating may include a ball rating and a club rating). By including an equipment rating into the calculation of a golf handicap, certain golf courses may become easier or more challenging, individuals with different golf skills may have more competitive rounds of golf while playing against each other, etc.

In contrast to the above examples with a ball rating only or a club rating only, the equipment rating may be a function of a ball rating and a club rating. In particular, the golf ball and golf club may affect the launch conditions of the golf ball at contact, and subsequently, the distance that the golf ball travels. As the golf ball and the golf club may be factors to determine the distance that the golf ball travels, the combination of the corresponding ball and club ratings may create the equipment rating, which in turn, may affect a golf handicap. Both ball and club ratings may be incorporated into one equipment rating value by using launch conditions as a unified measurement. That is, a sum of two independent ratings may provide an accurate measure of the launch conditions created when a golf ball with a particular ball rating is contacted (i.e., struck) by a golf club with a particular club rating.

In one example, by using a similar scale as the Slope Rating® with a minimum value of 55, a maximum value of 155, and an average value of 113, the equipment rating may affect the Handicap Index® in an appropriate manner (i.e., without overcompensation). Launch conditions associated with an average equipment rating of 113 does not change the Handicap Index® (i.e., the Handicap Index® and the adjusted handicap index are equal to each other). Further, the equipment rating may affect a relatively lower Handicap Index® less than a relatively higher Handicap Index®. By using a combination of ball and club ratings that create near ideal launch conditions such as a lower equipment rating of 83 (i.e., a golf ball and club combination that makes the golf ball travel a farther distance than a golf ball and golf club combination with the average equipment rating of 113), for example, an individual with a relatively low Handicap Index® such as 10 may change to an adjusted handicap index of 7.3 (i.e., a decrease of 2.7). On the other hand, that same individual may change from a Handicap Index® of 10 to an adjusted handicap index of 12.7 (i.e., an increase of 2.7) by using a relatively harder combination of golf ball and golf club such as a golf ball and golf club with an equipment rating of 143. As a result, the individual may be awarded for using a golf ball and golf club combination with a relatively higher equipment rating (e.g., 143) than for using a golf ball and golf club combination with a relatively lower ball rating (e.g., 83).

As the ball and club ratings may affect the launch conditions, these two independent ratings may be combined to create the equipment rating. In one example, an average-rated golf club may have a rating of 73. The club rating may be based on the position of the golf club head during a swinging motion. The factors to determine the position of the golf club head during a swing may include the center of gravity, the torsion of the shaft, the flexibility of the shaft, and/or the position of the shaft relative to the center of gravity. The higher that the golf club is rated, the less that the golf club may contribute to the launch conditions at contact with the golf ball, therefore making the club relatively harder. Likewise, an average-rated golf ball may have a rating of 40. The factors to determine the golf ball's contribution to the equipment rating may include the dimple pattern, moment of inertia, hardenss, mass, diameter, and/or spin propensity of a golf ball. The higher the ball is rated, the less that the golf ball may contribute to the launch conditions.

In the above example, an average-rated golf club may have a higher rating than an average-rated golf ball. As a result, the club rating may influence the equipment rating more heavily than the ball rating. Alternatively, the average-rated golf ball may have a higher rating than the average-rated golf club. By changing the average ball rating and/or the average club rating, the golf ball and/or the golf club may be weighted differently when the ball rating and the club rating are combined to create the equipment rating. Vice versa in another example, an average-rated golf ball may have a rating of 73 whereas an average-rated golf club may have a rating of 40. In this case, the average equipment rating may be 113 with the ball rating influencing the equipment rating proportionately more that the club rating. The systems, methods, apparatus, and articles of manufacture described herein are not limited in this regard.

As mentioned above, a ball rating and a club rating may be combined to create an equipment rating with an average of 113. By using a similar scale as the Slope Rating® with a minimum value of 55, a maximum value of 155, and an average value of 113, the equipment rating may affect the Handicap Index® in an appropriate manner (i.e., without overcompensation). The Slope Rating® and the equipment rating may have an inversely proportional relationship to keep the golf handicap constant as the Slope Rating® varies with different golf courses. That is, if the Slope Rating® and the equipment rating are offsetting each other, the golf handicap does not change the course handicap (i.e., handicap without the equipment rating). As the Slope Rating® increases, however, the equipment rating may need to be decreased to keep the golf handicap constant and vice versa. For example, an individual may play a golf course with a Slope Rating® of 96. To maintain the same golf handicap, the individual may use a combination of golf ball(s) and golf club(s) having an equipment rating of 133 to compensate for a golf course that is relatively easier than an average-rated golf course (i.e., 113).

Alternatively, the equipment rating may be scaled in a different manner (e.g., the ball rating and the Slope Rating® may be scaled or weighted differently). In one example, the equipment rating may be scaled differently with a minimum value of 6, an average value of 8, and a maximum value of 10. Launch conditions associated with an equipment rating of 8 may propel the ball farther (e.g., 10 to 20 yards) than launch conditions associated with either an equipment rating of 6 or an equipment rating of 7. However, launch conditions associated with an equipment rating of 8 may not propel the ball farther (e.g., 10 to 20 yards) than launch conditions associated with either an equipment rating of 9 or an equipment rating of 10. Similar to the above example, the golf handicap may be more precise and accurate with another factor in addition to a rating associated with the golf course played by an individual. The systems, methods, apparatus, and articles of manufacture described herein are not limited in this regard.

In another example, an individual with a relatively high Handicap Index® such as 20 may change to an adjusted handicap index of 14.7 (i.e., a decrease of 5.3) by using a golf ball and golf club combination that create more ideal launch conditions, such as launch conditions with an equipment rating of 83 (i.e., a golf ball and club combination that propels the ball a farther distance than a golf ball and golf club combination with the average equipment rating of 113), On the other hand, that same individual may change from a Handicap Index® of 20 to an adjusted handicap index of 25.3 (i.e., an increase of 5.3) by using relatively less-than-ideal launch conditions such as a launch conditions with an equipment rating of 143. If both individuals used a launch conditions with an equipment rating of 83, the individual with a Handicap Index® such as 10 may experience a change of 2.7 (i.e., an adjusted handicap index (AHI) of 7.3) whereas the individual with a Handicap Index® such as 20 may experience a change of 5.3 (i.e., an adjusted handicap index (AHI) of 14.7). As a result, the adjusted handicap index (AHI) may change from the Handicap Index® more significantly as the Handicap Index® value increases (i.e., the AHI is a function of the individual's Handicap Index®).

Turning back to FIG. 6, the process 600 may begin with calculating a course handicap based on at least one rating associated with a golf course played by an individual (block 610). In particular, the rating associated with the golf course may be a value indicating the difficulty of a golf course.

The process 600 may calculate a golf handicap based on the course handicap and a combination of ratings associated with a plurality of golf equipment used by the individual to play the golf course (block 620). For example, the rating associated with golf equipment used by the individual may be an equipment rating associated with a type of golf balls and a type of golf clubs used by the individual to play golf at the golf course. The systems, methods, apparatus, and articles of manufacture described herein are not limited in this regard.

An equipment rating system may allow an individual to select golf balls with a certain rating, and golf clubs with a certain rating, which in turn, may affect the equipment rating independently. As a result, the golf handicap of the individual for a particular round of golf may be determined by not only the Slope Rating® (i.e., golf course difficulty rating) but also the selection of golf equipment selected by the individual to play the round of golf.

In one example, putter-type golf clubs with different lengths may be associated with different ratings. In particular, a putter-type golf club with a length in a range between 30 to 40 inches (e.g., a standard-length putter) may be associated with a first rating whereas a putter-type golf club with a length in a range between 37 to 47 inches (e.g., a belly putter) may be associated with a second rating. Further, a putter-type golf club with a length in a range between 45 to 55 inches (e.g., a long putter) may be associated with a third rating. For example, the first rating may be relatively lower than the second or third ratings. The second rating may be the same or different from the third rating. In accordance with the example described above, a standard-length putter may be associated with an equipment rating of 6 whereas a belly putter or a long putter may be associated with an equipment rating of 8. In addition or alternatively, other characteristics of a putter-type golf club such as head weight, material (e.g., steel), and/or type (e.g., blade-type or mallet-type) may contribute to the rating of that putter-type golf club. The systems, methods, apparatus, and articles of manufacture described herein are not limited in this regard.

The equipment rating may be any single piece of equipment, or any combinations of two or more pieces of equipment. As the number of equipment ratings increase, an individual may have more flexibility to experiment and play without significantly affecting his or her golf handicap. The systems, methods, apparatus, and/or articles of manufacture described herein are not limited in this regard.

As the rules to golf may change from time to time (e.g., new regulations may be adopted or old rules may be eliminated or modified by golf standard organizations and/or governing bodies), golf equipment related to the systems and/or methods described herein may be conforming or non-conforming to the rules of golf at any particular time. Accordingly, golf equipment related to the systems and/or methods described herein may be advertised, offered for sale, and/or sold as conforming or non-conforming golf equipment. With the systems, methods, apparatus, and articles of manufacture described herein, an individual may use any golf equipment (e.g., conforming or non-conforming equipment according to golf standard organizations and/or governing bodies) and still be able to calculate a golf handicap. The systems, methods, apparatus, and/or articles of manufacture described herein are not limited in this regard.

Although certain example systems, methods, apparatus, and articles of manufacture have been described herein, the scope of coverage of this disclosure is not limited thereto. On the contrary, this disclosure covers all systems, methods, apparatus, and articles of manufacture fairly falling within the scope of the appended claims either literally or under the doctrine of equivalents.

What is claimed is:

1. A method of determining a golf handicap with a computing device comprising:

providing data associated with a course handicap to the computing device, wherein the course handicap is based on at least one rating associated with a golf course played by an individual;

providing data to the computing device associated with at least one rating associated with golf equipment used by the individual to play the golf course; and calculating a golf handicap with the computing device based on the course handicap and the at least one rating associated with golf equipment used by the individual to play the golf course.

2. A method as defined in claim 1, wherein providing the course handicap comprises providing the course handicap based on at least one of a course rating or a slope rating of the golf course.

3. A method as defined in claim 1, wherein providing the golf handicap comprises providing the golf handicap based on the course handicap and at least one of a golf ball rating or a golf club rating of the golf equipment.

4. A method as defined in claim 1 wherein the data associated with at least one rating associated with golf equipment used by the individual to play the golf course comprises a golf ball rating based on at least one golf ball used by the individual to play the golf course.

5. A method as defined in claim 1 wherein the data associated with at least one rating associated with golf equipment used by the individual to play the golf course comprises a golf club rating based on at least one golf club used by the individual to play the golf course.

6. A method as defined in claim 1, wherein calculating the course handicap comprises calculating the course handicap in accordance with the United States Golf Association Handicap System.

* * * * *